United States Patent [19]

Meyer

[11] 4,182,082

[45] Jan. 8, 1980

[54] METHOD FOR THE PROFILING OF GRINDING WHEELS AND APPARATUS THEREFOR

[75] Inventor: Hans-Robert Meyer, Hamburg, Fed. Rep. of Germany

[73] Assignee: Ernst Winter & Sohn (GmbH & Co.), Hamburg, Fed. Rep. of Germany

[21] Appl. No.: 870,717

[22] Filed: Jan. 19, 1978

[51] Int. Cl.[2] ..... B24B 53/06

[52] U.S. Cl. ..... 51/5 D; 125/11 R; 125/11 CD

[58] Field of Search ..... 125/11 CD, 11 R; 51/5 D, 262 T, 266

[56] References Cited

U.S. PATENT DOCUMENTS

| | | | |
|---|---|---|---|
| 2,337,183 | 12/1943 | Canning | 125/11 CD |
| 2,350,897 | 6/1944 | Jellis | 125/11 CD |
| 2,457,318 | 12/1948 | Polk | 125/11 CD |
| 2,914,058 | 11/1959 | Sommer | 125/11 CD |

*Primary Examiner*—Harold D. Whitehead

*Attorney, Agent, or Firm*—Toren, McGeady and Stanger

[57] ABSTRACT

A method for profiling of grinding wheels with diamond and/or cubic crystalline boron nitride, and apparatus for carrying out this method wherein a profiled roller and an abrasive block with corundum or silicon carbide are simultaneously pressed against the contour surface of a grinding wheel.

14 Claims, 6 Drawing Figures

METHOD FOR THE PROFILING OF GRINDING WHEELS AND APPARATUS THEREFOR

The present invention relates to a method for the profiling of grinding wheels containing at least one of the abrasives which include diamond and cubic crystalline boron nitride interspersed in a metallic brittle bond.

The invention further relates to an apparatus for the profiling of such grinding wheels in metallic brittle bond.

It is heretofore known to profile grinding wheels with diamond or cubic crystalline boron nitride during their manufacture; the grinding wheels are often pre-profiled during the pressing operation, and their final profile is then ground with grinding wheels of silicon carbide in ceramic or bakelite bond. This process is wasteful regarding the required production time as well as profile maintenance during the lifespan of the grinding wheels. The restoration of the profile necessitates return of the grinding wheels to the manufacturer. Diamond or boron nitride grinding wheels with complicated profiles, such as multiple thread profiles, cannot be produced at all in this manner. Thus, it is not possible until now to grind hard-alloy taps with multiple diamond profiled grinding wheels.

To make the use of profiled grinding wheels with diamond or cubic crystalline boron nitride possible, it is known to apply only one grain layer. However, once such grinding wheels have lost their precise profile, they cannot be used again.

Compared to grinding wheels with corundum or silicon carbide, grinding wheels as described above are of advantage for the grinding of profiles into materials difficult to grind, such as tungsten-carbides, high-speed and chromium steels, sintered metals with high carbide content, on account of lower heat exposure of the ground surface and smaller cutting forces. Further, use of grinding wheels with corundum, silicon carbide or boron carbide results in greater wear of the grinding wheels even with smaller output so that truing is more frequently necessary.

For the truing of such last-mentioned grinding wheels mainly diamond tools are used, for instance diamond profiled truing rollers which make it possible, by their considerably greater hardness, to profile such grinding wheels.

The use of truing tools with diamond for truing or profiling of grinding wheels with diamond or cubic crystalline boron nitride is either not possible at all or possible only with great wear of the truing tool, because it is essentially of the same hardness as the grinding tools itself. In the case of the mating of diamond with diamond equal hardness exists and in mating of diamond with cubic crystalline boron nitride the difference in hardness is so small that truing is only just possible. Profiled grinding wheels with diamond or cubic crystalline boron nitride are therefore not being trued in practice by means of diamond truing tools. Truing of diamond wheels by cold-forming techniques has hitherto only been possible to a depth of 0.5 to 0.7 mm. But this concerns diamond wheels with a soft metal bond. The applicability of such grinding wheels is limited. For cold-forming of deeper profiles, pre-forming by electric erosion operations must be carried out additionally, or a heat treatment with a temperature of 500° to 550° C. The effort is enormous.

Grinding wheels with diamond and with cubic crystalline boron nitride are known heretofore with brittle bonding and also with tougher and with more resilient bonding. But irrespective of this, grinding wheels with diamond and cubic crystalline boron nitride have so far only been profiled or trued with the method described above. Such grinding wheels have considerable advantages for the processing of materials difficult to grind.

Furthermore, a method is known for the truing of conventional grinding wheels with corundum or silicon carbide whereby a roller of steel, tungsten-carbide or the like is pressed against the grinding wheel, and grinding wheel and truing roller rotate around parallel axes. Either the grinding wheel is driven and the truing roller follows by frictional engagement therewith, or, on the contrary, the truing roller is driven and the grinding wheel follows correspondingly. Thus, the relative speed between grinding wheel and truing roller is kept to a minimum so that wear of the truing roller caused by frictional effects is kept as low as possible. At each rotation of the grinding wheel the truing roller presses once on those abrasive grains which protrude furthest from their bonding support. Under this pressure the grains break out of the brittle bonding of these grinding wheels. This rolling method is used particularly with grinding wheels with corundum or silicon carbide in ritrified bonding when the grinding wheel is to be provided with a profile at its contour surface. In that case the truing wheel has a profile on its contour surface which corresponds to the profile to be ground into the work piece.

It is an object of the present invention to provide a method for the profiling of grinding wheels by which method, with minimal effort and material consumption, even grinding wheels with diamond or cubic crystalline boron nitride may be profiled on their contoured surface and by which, particularly, worn grinding wheels may be reshaped in a simple manner within the required tolerances on production grinding machines whereby the abrasive capability of the grinding wheels with diamond or cubic crystalline boron nitride is maintained.

It is another object of the present invention to provide an apparatus for the realization of the method according to the present invention and for putting this method into practice.

In accordance with the present invention these objects are achieved by a method, and an apparatus for the realization of this method, for the profiling of grinding wheels containing at least one of the abrasives which include diamond and cubic crystalline boron nitride interspersed in a metallic brittle bond consisting of the two combined steps of (a) truing by rolling a profile into the contour surface of a grinding wheel with partial break-out and partial loosening of the material particles in the bonding; and (b) dressing the profile of the contour surface, directly after the profiling, by an abrasive block which continuously adapts itself to the profile.

According to the present invention, grinding wheels with diamond or cubic crystalline boron nitride with high abrasive capability and the rolling process are so coordinated by suitable grinding wheel bonds and rolling conditions that the diamond grains or boron nitride grains break out of the bond by the forces incident to the rolling but are mostly held in the bond by the forces and temperatures incident to the grinding. The breaking out of the diamond or boron nitride particles and their dressing provide conditions for a better structure of the grinding wheel surface than have existed hitherto only by truing or grinding. The dressing with the abrasive block renders the profile produced by the rolling further profilable and also suitable for grinding. The contour surface initially profiled is being partially loaded with broken-out particles and is, therefore, neither suitable for further profiling nor grinding but is now given the necessary structure also in the micro range.

Under this consideration, it is an especially preferred embodiment of the method of the present invention with at least one of the abrasives which include diamond and cubic crystalline boron nitride interspersed in a metallic brittle bond, but which also contains graphite. A graphite content is preferred in the range of magnitude of from 5 to 50 per cent by volume. This composition permits the achievement of especially precise profiles in that during the rolling of the profile into the contoured surface material particles are broken out whereby the profiled surface is strengthened at the same time because material particles are pressed into graphite pockets, and this produces a very precise profile in a mainly loaded surface. In a further, directly following step the loaded profiled surface is dressed directly afterwards with an abrasive block which adapts itself continuously to the contour of the profiled surface. This block breaks material particles out of the graphite pockets and brings the resultant profiled surface into a profilable condition again and suitable for grinding. This embodiment constitutes virtually a three-phase process in which particles are broken out, then pressed in and then exposed to dressing. This means that particles are loosened and removed and that also with effect upon the bonding, an excellent abrasive profile is attained which has a high precision and a high abrasive capacity even with deep profiles.

In this manner it is possible to produce deep profiles on grinding wheels as described above, for instance to a depth in the range of magnitude of about 10 mm, without having to adopt additional measures regarding tools or heating.

It is of advantage for this method to use an abrasive block which contains a material of the group comprising corundum and silicon carbide and holds this material in a bond chosen from ceramic or bakelite bonds. This allows an especially favorable execution of the method. According to the progress of the rolling process the abrasive block adopts a profile opposite to that of the grinding wheel and regenerates the contour surface of the grinding wheel. At the same time it produces an abrasive condition of the grinding wheel.

In this connection, the present invention comprises also the use of an abrasive block with one of the materials comprising corundum and silicon carbide in a bond which encompasses ceramic and bakelite bonds when rolling a profile with a steel or tungsten-carbide roller into a grinding wheel with a brittle metallic bond and with abrasive particles of a material group which comprises diamond and cubic crystalline boron nitride.

It is preferable to use for this method a grinding wheel the abrasive material of which lies in a grain size range of from 30 to 500 microns and, still more preferable, within a range of from 40 to 180 microns.

For the realization of this method a rotating roller of high-performance high-speed steel or tungsten-carbide is pressed with its possible profiled contour surface against the contour surface of a rotatably disposed grinding wheel with diamond and/or cubic crystalline boron nitride and one of the elements which is girted by the grinding wheel or the roller respectively is driven, and the idling member, i.e. the roller or the grinding wheel respectively takes part in the rotation. Also during the rolling process, the abrasive block is pressed against the contour surface of the grinding wheel.

It is useful to employ a roller profiled at the contour surface which may consist of hardened steel, for instance of the type AISI L3. By this frictional entrainment a different speed is substantially or largely avoided. In this method with diamond and/or cubic crystalline boron nitride, heat generation will be low; the properties of the abrasive particles and the wheel bonding will not be altered.

For this method for instance a brittle bronze as bonding for the grinding wheel has proved suitable. This bronze may have a tin content of from 30 to 55 wt. %, and a copper content of from 70 to 45 wt. % and include a graphite content of from about 5 to 50 vol. %. This composition has proved itself for diamond as well as for cubic crystalline boron nitride.

The apparatus for the profiling of grinding wheels includes a stand with a shaft for the grinding wheel and a further shaft for the roller whereby one of these shafts is driven and the other shaft is disposed so as to be freely rotable. A drive motor for the driven shaft is mounted on the stand. Two guide tracks are arranged in the stand vertically to the bearing of the shaft for the grinding wheel. In one guide track a further bearing is slidably disposed for the further shaft that carries the roller. In the further guide track a carrier arm for the abrasive block is slidably disposed. Each guide track is furnished with pressure means which presses the second shaft and its associated roller and respectively the abrasive block against the grinding wheel. An advantageous embodiment is that the first shaft which is space-bound on the stand will also be the driven shaft.

In the following, the method and the apparatus according to the present invention will be described more in detail with reference to various embodiments shown in the appended drawings wherein FIG. 1 is a schematical side elevation of several major components of an embodiment of the apparatus in accordance with the present invention;

Figure 1:
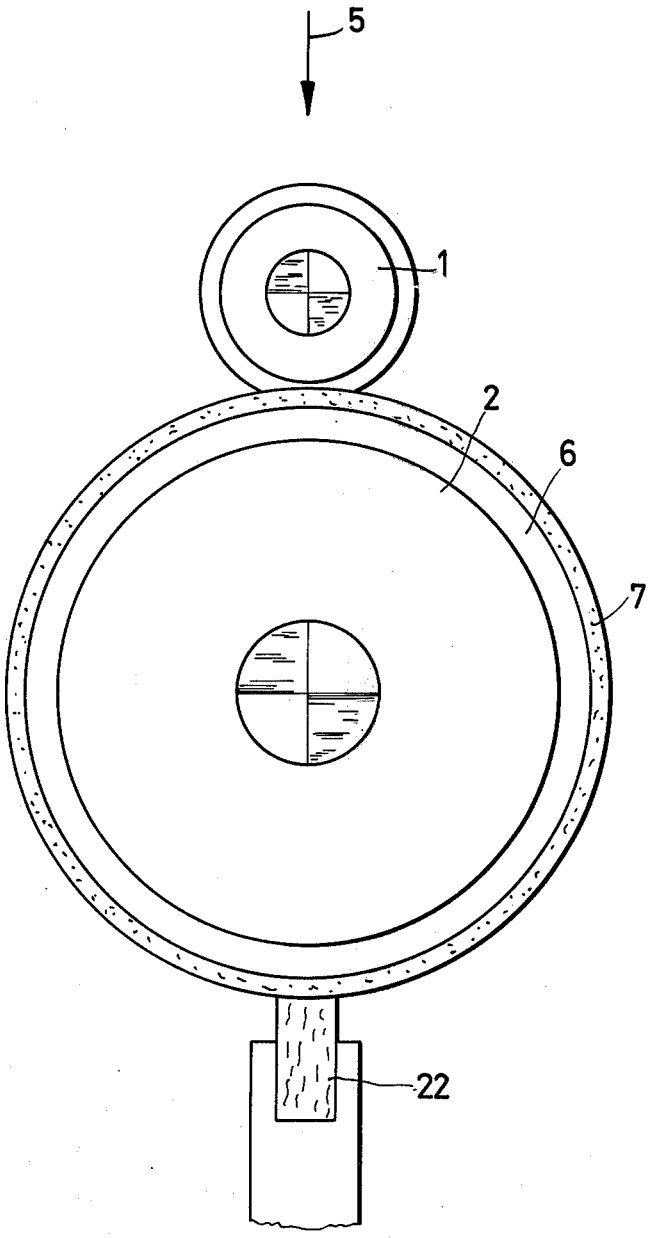

Referring to the drawings, by way of example, a diamond grinding wheel 2 may have a diameter of 300 mm and a width of 45 mm. The grinding wheel is constructed of a steel body, a lining carrier 6 of bronze with 85 wt. % copper, and a lining 7. The lining 7 consists of brittle bronze, diamond and graphite. The graphite content of the lining 7 is 40% by volume. The brittle bronze contained in the lining 7 consists of 44% by weight copper and 56% by weight tin.

The lining 7 is made in a diamond grain size of D 126 according to FEPA standards and a diamond concentration of 3.3 carats per cubic centimeter of lining volume. Diamond and/or cubic crystalline boron nitride with grain sizes ranging from 30 to 500 microns may be employed whereby a range of from 40 to 100 microns is preferred.

The diamond grinding wheel 2 is mounted on a firmly driven but rotatably mounted shaft 4 so that the grinding wheel rotates with a circumferential speed of 1.1 m/sec. A profiled roller 1 of hardened steel with the specification AISI L3 of a diameter of 110 mm and a width of 45 mm. rolls along the contour surface of the grinding wheel 2. The profile of the roller may be selected in accordance with given requirements and the depth of the profile may be up to 10 mm or more.

The profiled roller 1 is rotatably disposed on a shaft 3. This shaft 3 is biased by a downwardly directed force as indicated by the arrow 5 so that the profiled roller 1 which by itself would be freely rotatably will be entrained, due to its frictional engagement with the contour surface of the grinding wheel. Once contact has been made, the profiled roller 1 will be pressed toward the diamond grinding wheel at an advance or feed speed of 1.7 microns per second. Thereby may be exerted a pressure of about 2 to 12 kp per mm of width of contact area. Sufficient profilation is already attained at 3 kp per mm. The depth of profile, after the rolling process, may for example amount to 2 mm.

During the rolling process, an abrasive block 22 with corundum or silicon carbide in ceramic or bakelite bond is continuously pressed against the contour surface of the grinding wheel. The abrasive block puts the profiled and compressed contour surface into a condition in which this surface may be profiled further and will be suitable for grinding whereby the profile is retained.

It is advantageous to exert a resilient force for pressing the abrasive block 22 against the grinding wheel. This force may be generated by mechanical means such as by the use of a weight or spring members, or likewise also by pneumatic or hydraulic pressure devices. In the case of hydraulic pressure devices for the abrasive block, resilience may be attained by a spring-loaded relief valve or by a reservoir that will be loaded in opposition to a spring force. It is also expedient to obtain the pressing force for the profiled roller from hydraulic actuation means. The pressure preferably amounts to 1 kp per centimeter of width of grinding wheel.

Figure 2:
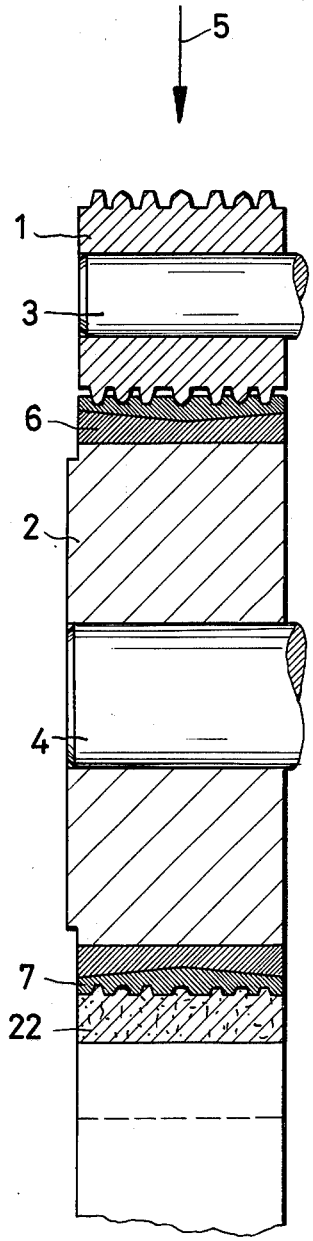
FIG. 2 is a sectional front elevation of the apparatus shown in FIG. 1.
Figure 3:
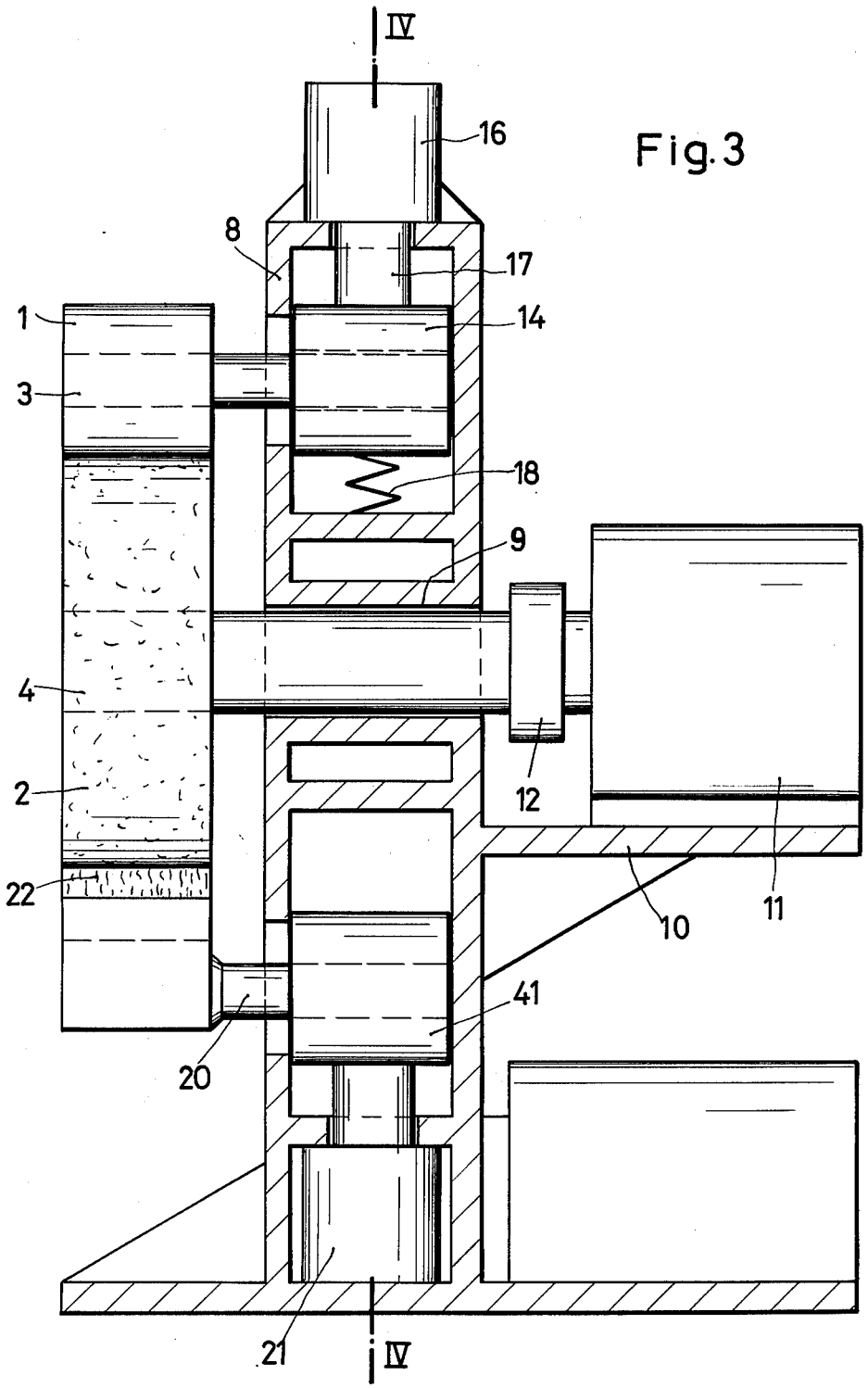
FIG. 3 is a sectional front elevation of another embodiment of an apparatus embodying the present invention, along the line III—III of FIG. 4.
Figure 4:
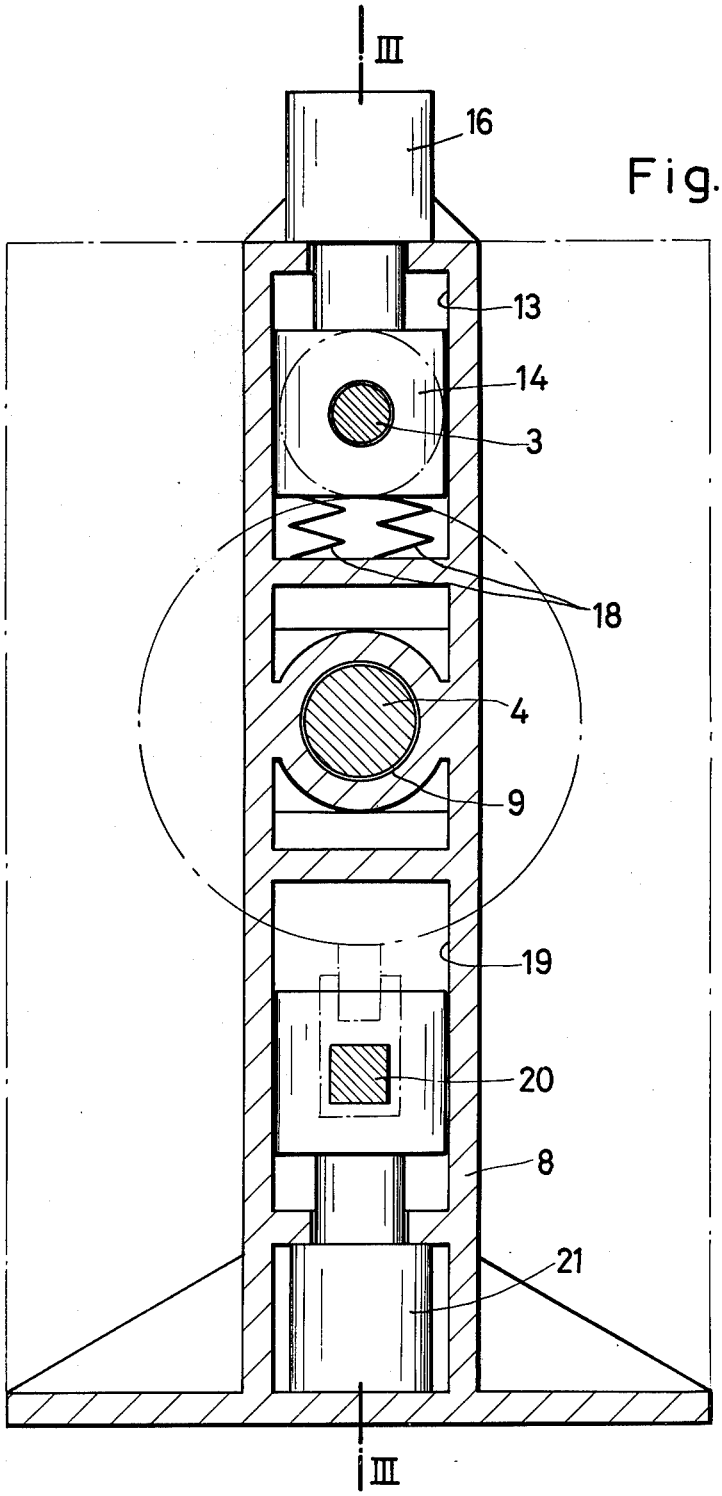
FIG. 4 is a sectional side elevation along the line IV—IV of FIG. 3.
Figure 5:
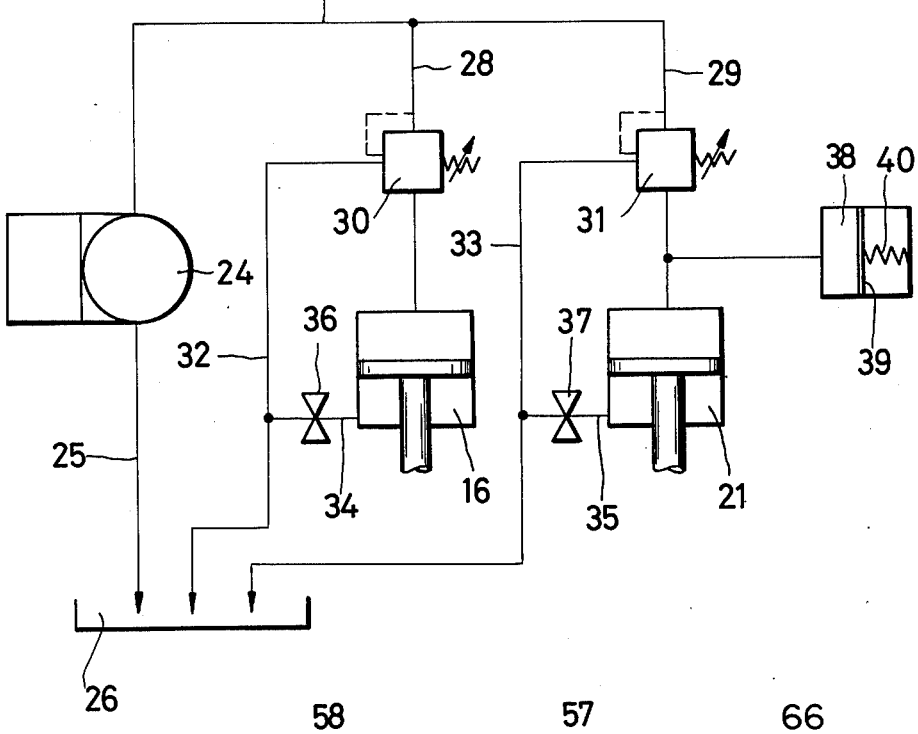
FIG. 5 is a block diagram of pressure means for the apparatus.

In FIGS. 3 to 5 is shown an apparatus wherein for similar components as shown in FIGS. 1 and 2 the same reference numerals are used.

In a stand 8 are disposed bearing means 9 for the shaft 4. These bearing means 9 are rigidly mounted in the stand 8. The grinding wheel 2 and the shaft 4 are rigidly interconnected and rotate in unison. In line with the bearing means 9, stand 8 supports a bracket table 10 for a geared motor 11. The motor 11 is connected to the shaft 4 through a clutch 12. For instance, a guide track 13 may be disposed in an upper portion of the stand 8, and this guide track will be oriented vertically to the axis of the bearing means 9; in this example, in a vertical direction. Further bearing means 14 are movably disposed in the guide track 13. These bearing means 14 may move in the indicated directions. A further shaft 3 is disposed in the further bearings 14 and carries the profiled roller 1. Either the further shaft 3 is rotatable in the further bearing means 14 or the profiled roller 1 may rotate on the further shaft 3 that is oriented in a direction parallel to the shaft 4.

Pressure means 16 are mounted on the stand 8 and serve to actuate the further bearing means 14. These further pressure means are connected, by a transmitting member 17, with the further bearing means 14 and exert a force thereon in the direction of the bearing means 9. For instance, counter pressure means 18 may be provided for lifting the further bearing means 14 away when the first bearing means are relieved. These counter pressure means 18 may, for instance, consist of springs that exert a lesser pressure than the pressure means 16 when activated.

The stand 8 includes a further guide track 19 that is oriented vertically to the axis of the bearing means 9, but includes an angle with the guide track 13. This angle may, for example, be 180° so that the tracks 13 and 19 are oriented in opposition to each other. In the further guide track 19 is movably disposed a carrier arm 20 for mounting an abrasive block 22. Thus the abrasive block may be moved towards the grinding wheel 2 in a direction vertically or radially to the shaft 4. The further guide track 19 is associated with further pressure means 21 which are connected with the carrier arm 20 and, in the embodiment shown, urge this carrier arm upwardly. The carrier arm 20 firmly holds an abrasive block 22. The arrangement is such that the profiled roller 1 and the abrasive block 22 may be pressed or urged against the grinding wheel 2 from different directions. The respective urging pressures may be of different magnitudes.

It is obvious that, alternatively, the further shaft 3 may be driven, in which case the profiled roller 1 would be securely attached to this shaft and the grinding wheel 2 would be held so as to be freely rotatable on the shaft 4.

FIG. 3 does not shown the profiles which are explained with reference to FIGS. 1 and 2.

It is most useful to mount on the stand 8 a power source 23 (not shown in the drawings) which serves to energize the pressure means 16 and 21 respectively. Also, no lines are shown in FIGS. 3 and 4 but it will be understood that such lines would be necessary for hydraulic pressure means. Such lines are, however, indicated in FIG. 5. The power source comprises a motor driven pump 24. The inlet of this pump 24 communicates through line 25 with an hydraulic fluid reservoir 26. The pressure outlet of the pump 24 is connected through a line 27 and the branch lines 28, 29 with the pressure means 16, 21 which may, for instance, consist of suitable cylinder and piston assemblies. The branch lines 28, 29 include pressure limiting devices 30 and 31 respectively that are controllable and connected to the hydraulic fluid reservoir 26 through return lines 32 and 33 respectively. The pressure chambers of the pressure means 16, 21 are connected to the respective return line over a respective line 34 or 35. These lines 34, 35 may include relief valves 36, 37 respectively that may be controlled manually or automatically.

Since particularly the abrasive block 22 is to be actuated in a resilient manner, an expansion reservoir 38 is connected to branch line 29. This reservoir 38 has a movable partition 39 which is supported either by elastic means 40 or by the pressure exerted by a compressible gas.

The apparatus and the method of the present invention are characterized by the profiled roller and the abrasive block acting on the grinding wheel simultaneously. The apparatus may also be provided as a part of a grinding machine. In this case, the arrangement is such that the grinding wheel in its role of a tool acts upon a work piece downstream of the abrasive block with respect to its direction of rotation.

Figure 6:
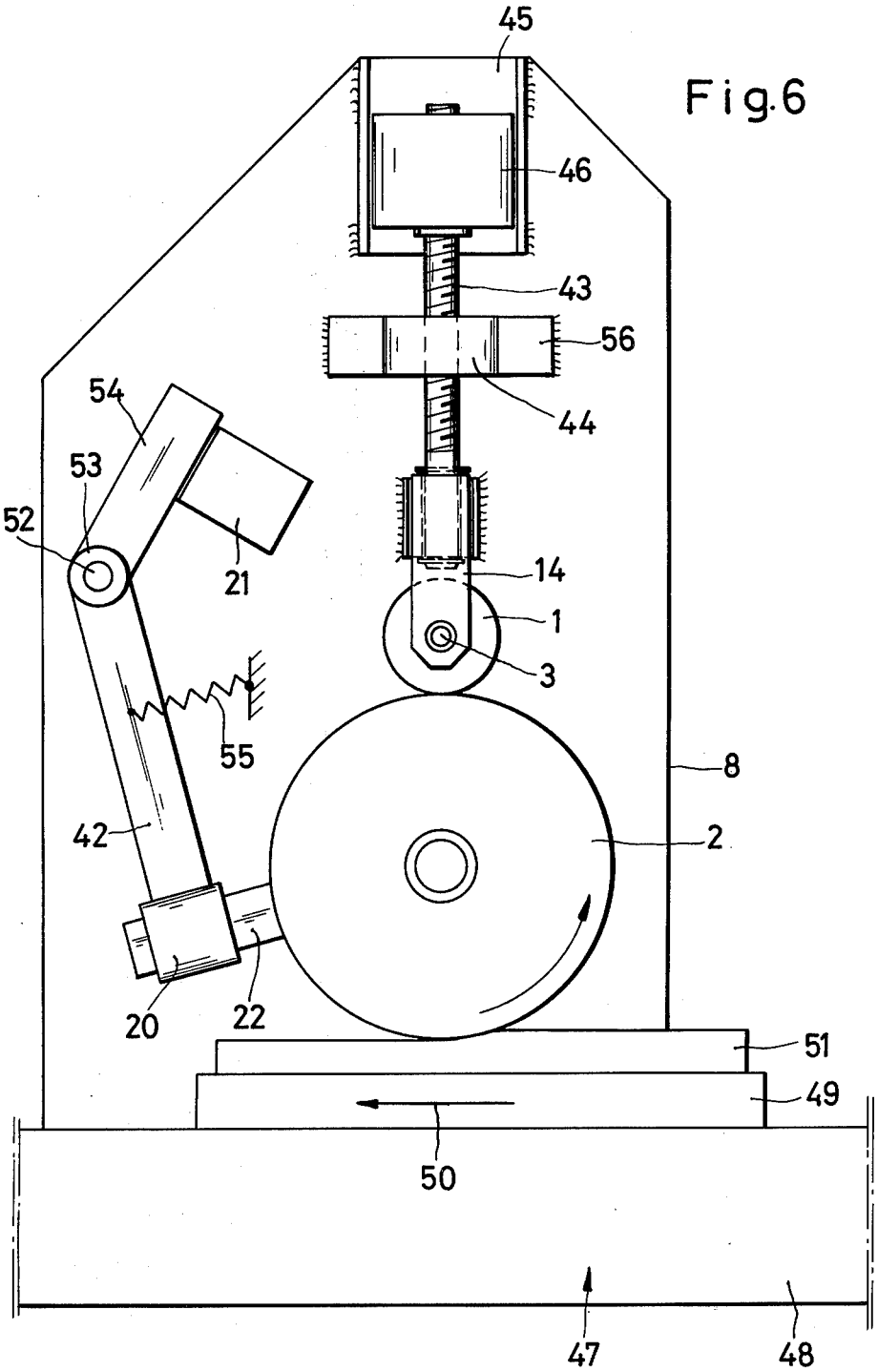
FIG. 6 is a schematic side elevation of another embodiment of the invention.

The apparatus is shown in FIG. 6 as part of a grinding machine. This machine may consist of a surface grinder 47 as shown schematically. This machine includes a bed 48 on which is movably disposed a carriage 49 for movement in the direction of the headed arrow 50. A work piece 51 to be machined by the grinding wheel 2 is securely mounted on the carriage, for instance by means of a known magnetic chuck. Mounted to the bed is also the stand 8 with the grinding wheel 2. Components that correspond to similar components of the apparatus as described above are designated by the same reference numerals. It may be seen that the carrier arm 20 with the abrasive block 22 is mounted on a rocking lever 42. This rocking lever 42 is pivotably mounted about a journal 52. The journal 52 is mounted rigidly in the stand 8. A bearing bush 53 which holds the journal 52 is connected to the pivot lever 42. A lever arm 54 is mounted on the bearing bush 53. The further pressure means 21 are, for instance, mounted on this lever arm 54 in a direction so that the abrasive block 22 may be urged against the grinding wheel 2 in a substantially radial direction. In the embodiment, shown here, lifting means are provided, such as in the form of a spring 55, for lifting the abrasive block 22 off the grinding wheel 2 when the further pressure means 21 are deactivated or inoperative. These further pressure means 21 are attached to the stand 8 by means of their casings.

In the embodiment shown in FIG. 6 the profiled roller 1 is disposed in a fork type journal or bearing means 14 which receives the profiled roller 1 by two legs on both sides. The further shaft 3 is disposed in this case so as to be freely rotatable between the legs. A threaded spindle 43 is mounted rotatably but non-movable in its axial direction at the fork type bearing means 14 and serves as engaging means. This threaded spindle 43 penetrates a nut 44 which is secured to the stand 8 by a bracket 56. The stand 8 also mounts a support 45 for an actuating motor 46. The housing of this actuating motor is secured against rotation with respect to the support 45 but may be moved in a vertical direction with respect to this support 45. The rotor of this motor 46 is integrally connected with the threaded spindle 43.

By the described arrangement it is possible to adjust the profiled roller 1 during the profiling of the grinding wheel 2 or to lift the roller off the grinding wheel during a grinding operation. In a corresponding manner, the abrasive block 22 may optionally be urged against the grinding wheel or lifted off the grinding wheel.

When the grinding wheel 2 is being profiled, the carriage 49 is moved out of the way so that the grinding wheel may rotate freely. During profiling, the circumferential speed of the grinding wheel may be selected to be about 0.5 to 2.0 m/sec. When the tools 1 and 22 have been lifted off from the grinding wheel and the grinding operation is being carried out, the grinding wheel is driven at a circumferential speed in a speed range of from 30 to 40 m/sec.

During profiling of the grinding wheel the abrasive block 22 is being biased under a pressure force on the order of magnitude of about 0.5 to 2.0 kp/cm.

Figure 7:
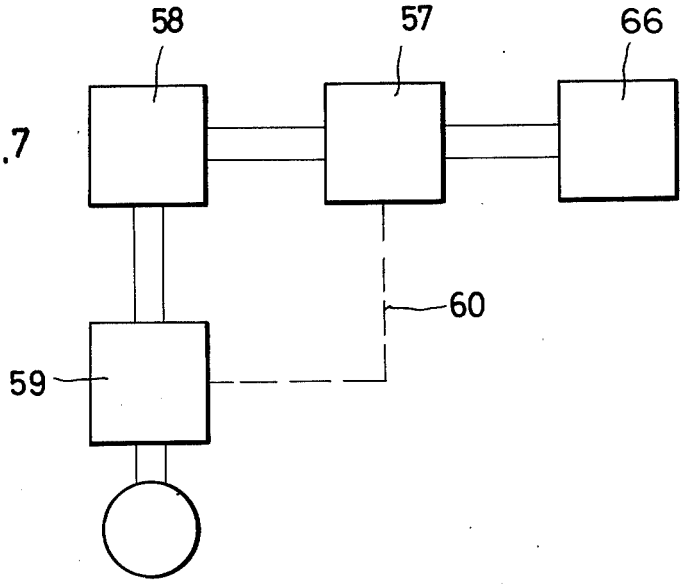
FIG. 7 is a block diagram of the functional relationship between components of FIG. 6.

The above indicated pressures and speeds merely represent advantageous data. In contrast to the arrangement of FIG. 5, FIG. 6 does not show the pressure means 16. Instead, as shown in FIG. 7, a rotary actuator 66 is provided. This rotary actuator is connected to a power supply 58 over a reversing switch 57. The motor 46 is likewise connected to the power supply 58 over a switch 59. With respect to speed interdependencies, functional connections 60 may be provided between the switches 59 and 57. It is suitable to include this drive circuitry in the circuitry (not shown) of the surface grinder 47 that would, otherwise, be of a conventional design.

I claim:

1. A method for the profiling of grinding wheels containing at least one of the abrasives selected from the group consisting of diamond and cubic crystalline boron nitride, interspersed in a metallic brittle bond, said method comprising the steps of:

(a) truing a grinding wheel by rolling a profile into the contour surface of said grinding wheel, said truing being performed with partial break-out and partial loosening of the material particles in the bonding of said wheel; and (b) dressing the profile of said contour surface of said wheel, by applying against said wheel immediately subsequent to said rolling of said profile, an abrasive block which continously adapts its shape to the profile of said wheel.

2. A method for the profiling of grinding wheels containing at least one of the abrasives diamond and cubic crystalline boron nitride interspersed in a metallic brittle bond which has a graphite content of from 5 to 50 volume per cent, said method comprising the steps of:

(a) truing a grinding wheel by rolling a profile into the contour surface of said grinding wheel with partial breaking out of the material particles thereof;

(b) simultaneously strengthening the profile of the contour surfaces by pressing material particles into graphite pockets thereby to produce a precisely defined profile on a surface which is loaded to a considerable degree; and (c) dressing this profiled contour surface immediately subsequent to the profiling step by means of an abrasive block that continously adapts its shape to the profile whereby particles of material are broken out from the graphite pockets and the resultant profile surface is brought into a condition suitable for further profiling and grinding.

3. A method as defined in claim 2 wherein said abrasive block is formed of a composition containing a material selected from the group consisting of corundum and silicon carbide, and wherein said material is present in a bond selected from the group consisting of ceramic and bakelite type bonds.

4. A method as defined in claim 3 wherein said rolling a profile is performed with a steel or tungsten-carbide roller.

5. A method as defined in claim 2 wherein said grinding wheel comprises abrasive material which is within a grain size range of from 30 to 50 microns and preferably from 40 to 180 microns.

6. An apparatus for the profiling of grinding wheels which include at least one of the abrasives diamond and cubic crystalline boron nitride interspersed in a metallic brittle bond, said apparatus comprising a stand (8), bearing means (9) disposed in said stand (8), a shaft (4) rotatably mounted in said bearing means (9), a grinding wheel (2) mounted on said shaft (4), guide means (13) extending vertically to said bearing means (9) in stand (8), further bearing means (14) movably disposed in said guide means (13) in the direction toward said bearing means (9), a further shaft (3) in said bearing means (14), pressure means (16) connected with said further bearing means (14) for moving said further bearing means in the direction toward said bearing means (9), further guide means (19) provided at said stand (8) at an angle with respect to said guide means (13) and mainly vertically to said bearing means (9), a carrier arm (20) for supporting an abrasive block (22) in said further guide means (19), further pressure means (21) in said stand (8) and connected with said carrier arm (20) for moving said carrier arm in a direction towards said bearing means (9), a motor a motor (11) for driving one of said shaft (4) and said further shaft (3), and a profiled roller (1) formed of a material which includes steel and tungsten-carbide mounted on said further shaft (3), said abrasive block (22) being mounted on said carrier arm (20), with one of said grinding wheel (2) and said profiled roller (1) which is mounted on said one of said shaft (4) and said further shaft (3) which is driven by said motor (11) being fixedly connected thereto, the other of said grinding wheel (2) and said profiled roller (1) being freely rotatably mounted on the other of said shaft (4) and said further shaft (3).

7. An apparatus as defined in claim 6 in which the guide means (13, and 19) consist of guide tracks disposed in the stand (8), and the further bearing means (14) and a guide block (41) for the carrier arm (20) for the abrasive block (22) are slidably arranged in a guide track (13 or 19 respectively) and are adapted to be moved in the direction of the respective guide track by the pressure means (16 or 21 respectively).

8. An apparatus as defined in claim 7 in which counter pressure means (18) are disposed within the guide means (13) for the further bearing means (14) for moving this means away in the direction of the bearing means (9) whereby the pressure means (16), when activated, are adapted to exert a greater pressure than the counter pressure means (18).

9. An apparatus as defined in claim 6 wherein the pressure means (16, 21) are designed in the form of cylinder piston assemblies, a motor driven pump (24) and an hydraulic fluid reservoir (26) are disposed at the stand (8), the intake side of said pump (24) communicating with the hydraulic fluid reservoir (26), and the pressure side of the pump being connected over pressure limiting devices (30, 31) to pressure means (16) and to further pressure means (21) respectively, one return line each (32, 33) connected to the hydraulic fluid reservoir (26) and a connection (34, 35) being provided between the pressure chamber of the pressure means (16) and further pressure means (21) respectively to the relating return line (32, 33) and also an openable valve (36 or 37).

10. An apparatus as defined in claim 9 wherein an expansion reservoir (38) with a resiliently supported movable partition (39) is connected to the branch line (29) communicating with the further pressure means (21).

11. An apparatus as defined in claim 6 whereby the stand (8) with its attendant components or parts is arranged in a surface grinding machine (47).

12. Apparatus for profiling wheels which include at least one of the abrasives diamond and cubic crystalline boron nitride interspersed in a metallic brittle bond, said apparatus comprising a stand, first bearing means disposed in said stand, a first shaft rotatably mounted in said first bearing means, a grinding wheel mounted on said first shaft, first guide means extending generally perpendicularly to said first bearing means in said, second bearing means movably disposed in said first guide means in a direction toward said first bearing means, a second shaft in said second bearing means, first pressure means connected with said second bearing means for moving said second bearing means in a direction toward said first bearing means, second guide means provided on said stand, carrier arm means operatively associated with said second guide means for supporting an abrasive block, an abrasive block mounted on said carrier arm means, second pressure means on said stand connected with said carrier arm means for moving said carrier arm means in a direction toward said first bearing means, a motor for driving one of said first and said second shafts, and a profiled roller formed of a material suitable for rolling a profile into a contour surface of said grinding wheel, said profiled roller being mounted on said second shaft, with one of said grinding wheel and said profiled roller which is mounted on said one of said first and said second shaft driven by said motor being fixedly connected thereto, the other of said grinding wheel and said profiled roller being freely rotatably mounted on the other of said first and said second shaft, said second guide means comprising a rocking lever rotatably arranged on said stand, said carrier arm means for said abrasive block being attached to a free end of said rocking lever which is pivotable essentially radially with respect to said first bearing means and which is actuated by said second pressure means, with release means being associated with said second pressure means for lifting said abrasive block off said grinding wheel.

13. Apparatus according to claim 12 wherein said first pressure means comprise a threaded spindle and a rotary actuator with a nut being disposed at said stand for guiding said threaded spindle, a support for said rotary actuator being provided on said stand with said actuator being guided in said support for vertical movement but being secured against rotation with respect to said support.

14. A method for profiling a grinding wheel having a composition including at least one of the abrasives diamond and cubic crystalline boron nitride interspersed in a metallic brittle bond, said method comprising the steps of: applying against said grinding wheel at a first location on the periphery thereof a roller structured to effect truing of said grinding wheel by rolling of a profile into a contour surface of said grinding wheel on the periphery thereof; and simultaneously applying against said grinding wheel at a location on the periphery thereof other than said first location an abrasive block structured to continously adapt its shape to the profile of said grinding wheel, said block effecting dressing of the profile of said contour surface of said wheel.

* * * * *